US005307525A

United States Patent [19]

O'Brien

[11] Patent Number: 5,307,525

[45] Date of Patent: May 3, 1994

[54] BATHROOM ODOR ELIMINATOR

[76] Inventor: John W. O'Brien, 607 S. Kelly St., Harrison, Ark. 72601

[21] Appl. No.: 951,885

[22] Filed: Sep. 28, 1992

[51] Int. Cl.[5] ..... E03D 9/02

[52] U.S. Cl. ..... 4/300.3; 4/222; 4/223

[58] Field of Search ..... 4/300.3, 222, 223, 229, 4/230, 231, 241; 251/4, 5, 6

[56] References Cited

U.S. PATENT DOCUMENTS

| | | | |
|---|---|---|---|
| 641,238 | 1/1900 | Ruthven | 4/223 |
| 1,712,816 | 5/1929 | Elliott | 4/229 |
| 2,444,441 | 7/1948 | Grinham | 4/223 |
| 2,946,065 | 7/1960 | Smith | 4/223 |
| 2,961,664 | 11/1960 | Davidson | 4/229 |
| 2,989,076 | 6/1961 | Rohmann | 251/6 |
| 3,088,125 | 5/1963 | Southwood | 4/222 |
| 3,316,559 | 5/1967 | Ewing | 4/223 |
| 4,028,747 | 6/1977 | Newton | 4/10 |
| 4,670,916 | 6/1987 | Bloom | 4/222 |

FOREIGN PATENT DOCUMENTS

| | | | |
|---|---|---|---|
| 1127352 | 8/1956 | France | 4/223 |

*Primary Examiner*—Henry J. Recla
*Assistant Examiner*—Charles. R. Eloshway
*Attorney, Agent, or Firm*—Stephen D. Carver; J. L. Mahurin

[57] ABSTRACT

As an improvement for eliminating lingering bathroom odor, a few drops of an appropriate fluid mixture such as a chlorinated hydrocarbon containing a small amount of a volatile fragrant fluid is added to water in a toilet bowl prior to the use of the toilet. A unique property of the first fluid causes the resultant mixture to spread quickly over the entire surface of the water, forming a nonpermeable film across which the odor emanating from unflushed feces cannot pass. The second fluid quickly vaporizes from this film allowing the resulting concentrated fragrance to neutralize within the toilet bowl the flatulence odor produced during a bowel movement. A person sitting upon the toilet seat actuates a semiautomatic fluid dispenser.

16 Claims, 3 Drawing Sheets

BATHROOM ODOR ELIMINATOR

BACKGROUND

1. Field of Invention

This invention relates to an improved method of eliminating bathroom odor by trapping and neutralizing it at its source within the toilet bowl.

2. Description of Prior Art

Bathroom odor is currently reduced by exhausting the foul smelling air out of the building by means of an exhaust fan and associated duct work, or by neutralizing the odor through the use of air fresheners which release into the air a stronger less obnoxious scent, or by adding a pleasant scent to the toilet flushing water using slowly dissolving solids.

The exhaust fan method requires expensive installation, generates considerable noise when in operation, requires the toggling of an on-off switch for operation, and is not available in older houses or in all bathrooms in many newer houses. Exhausting the air requires either heating or dehumidifying and cooling the incoming replacement air. The fan uses electric power during its operation. Normally neither the fan shutters or exhaust ducts are insulated, and there is a small amount of air leakage through the shutters, all of which constitute additional energy loss. So this odor handling method is both inconvenient and uses energy for its operation.

Spraying a perfumed mist into the air is also inconvenient and the strong scent required to cover the odor can be almost as offensive as the original odor it attempts to cover. This heavy perfume drifts into other rooms when the bathroom door is left ajar to dissipate it.

Perfumes from evaporating solids produce an unnecessary constant background scent and require frequent replacement if the evaporation rate is set high enough to adequately cover the odor. This floods adjacent rooms with an unneeded scent when the bathroom door is left open for any length of time.

Slowly dissolving scented solids placed in a toilet water reservoir add perfume to water used for flushing as a means of neutralizing bathroom odor. Most of this treated water is lost during flushing. The small amount of treated water remaining in the toilet bowl is diluted considerably by untreated water added to bring the water level up to the proper height during a reservoir refilling cycle. As a result, the small amount of perfumed water remaining in the toilet bowl is insufficient to adequately cover either odor in the water or odor escaping into the air during a bowel movement. Another additional means of odor control is therefore required for complete control of bathroom odor. This is an inefficient, inadequate and expensive means of odor control.

Since my invention uses an entirely different means of odor control than those described above, listing prior art on these odor control methods is not deemed necessary.

The use of oil as a flushing means is exemplified by U.S. Pat. No. 4,025,747. Since odor control is not the purpose of this type of prior art, my invention does not infringe.

OBJECTS AND ADVANTAGES

Several objects and advantages of the present invention are:

a) to block the escape into the air of odor emanating from water containing feces in a toilet bowl.

b) to neutralize flatulence odor released during a bowel movement while said flatulence odor is still confined within the toilet bowl.

c) to permit a toilet containing feces to remain unflushed for an extended period of time without emitting odor, even while being used several times during this period, as a means of conserving water in regions having water shortage or water rationing.

d) to eliminate the need for using an exhaust fan to remove odor in a bathroom, thereby saving energy.

d) to provide semi-automatic dispensing means for the odor suppressing and odor neutralizing fluid described in this invention, which allows fluid dispensing to take place with minimum intervention by the user.

e) to create a minimum impact upon the environment by using biodegradable fluids.

f) to create an inexpensive method of bathroom odor control by using as a primary ingredient a readily-available low-cost fluid designed for other purposes and having the desired properties which include requiring only a few drops of this fluid for proper odor control.

DRAWING FIGURES

REFERENCE NUMERALS IN DRAWINGS

Figure 1:
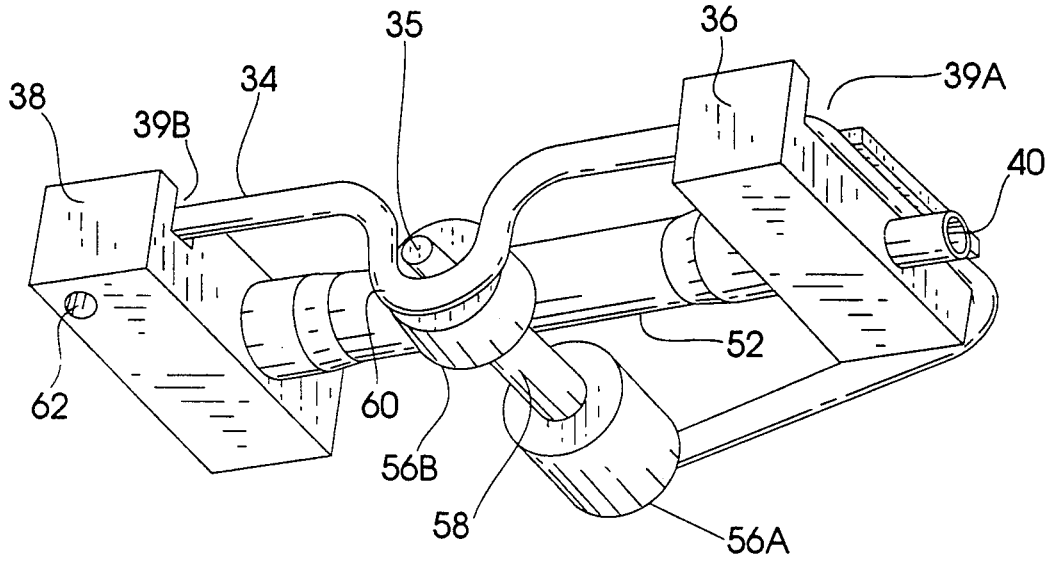
FIG. 1 shows a lower perspective view of the semiautomatic fluid dispenser.

| | | | |
|---|---|---|---|
| 22 | section of toilet bowl | 24 | top face of toilet bowl |
| 26 | inside face of toilet bowl | 28 | outside face of toilet bowl |
| 30 | section of toilet seat | | |
| 32 | bottom face of toilet seat | 31 | top face of toilet seat |
| 35 | pump actuating section of spring | 34 | torsion wire spring |
| | | 36 | inlet block |
| 38 | outlet block | 39A and 39B | spring mounting slot |
| 40 | fluid inlet hose connection | | |
| 42A and 42B | check inlet ports | 41A and 41B | check housings |
| 46A and 46B | check balls | 44A and 44B | check seats |
| 50A and 50B | check outlet ports | 48A and 48B | check spring |
| 53 | fluid inlet channel | | |
| 56A | long actuating roller | 52 | rubber tube |
| 58 | tube flattening sleeve | 54 | fluid outlet channel |
| 62 | fluid exit port | 56B | short actuating roller |
| | | 60 | spring travel stop loop |
| | | 64A and 64B | attachment faces |

DESCRIPTION OF THE INVENTION

This invention comprises a method of eliminating lingering bathroom odor through the use of some unique properties of certain fluids as a means of blocking and neutralizing this odor within a toilet bowl; and a device for semiautomatically dispensing these fluids into a toilet bowl without the conscious involvement or awareness of the user.

Certain fluids such as chlorinated hydrocarbons commonly used in a diluted form in industry as coolants for machining operations have a unique property of quickly forming a thin film over the surface of a body of still water when applied in an undiluted state. This film in turn has a unique property of preventing the transfer of gases dissolved in this water from escaping into the air above this film. These properties are used to block the escape into the air of odor emanating from feces in the water in a toilet bowl, which is the primary source of bathroom odor.

A non film-forming aromatic hydrocarbon fluid such as methyl salicylate can be mixed with this film-forming fluid in a quantity small enough so that the resultant fluid mixture still retains this film-forming property, and this mixture applied to a body of still water, as a method of increasing the surface area of this aromatic hydrocarbon exposed to air, thereby greatly increasing the rate of release of a pleasant odor.

The presence of this pleasant odor in the confined air in a toilet bowl neutralizes the flatulent odor released into this air during a bowel movement.

Since the rate of release of this pleasant odor is also temperature dependent, this release rate can be additionally increased by warming this film through the introduction of water warmer than the cooler water underlying this film, since the warmer water forms into a layer just under this film because of the higher specific gravity of the cooler water. The introduction urine at body temperature into this cooler body of water can perform this function. The introduction of feces at body temperature can also have this same warming effect due to the cooler water in contact with feces becoming warmed and subsequently rising and mixing with the warm urine layer.

The use of a fluid mixture composed of these odor blocking and odor neutralizing fluids thus provides an effective method of combating lingering bathroom odor.

As a method of conserving water, this fluid mixture may be introduced into a toilet bowl in a sufficient quantity to permit the resultant film to be replenished as it is gradually absorbed into the water over a period of time, thus eliminating the need to flush the toilet after each use. The use of this fluid eliminates the need for using an odor exhausting fan, thereby also conserving energy.

Figure 2:
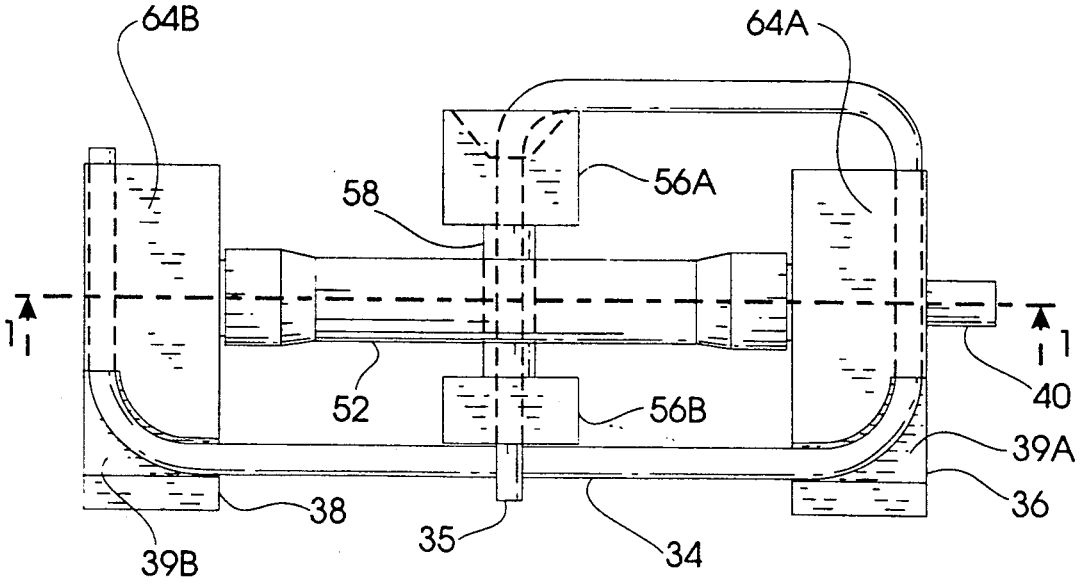
FIG. 2 shows a top plan view of the semiautomatic fluid dispenser.

A typical embodiment of the semiautomatic fluid dispenser of the present invention is illustrated in the lower perspective view of FIG. 1 and the top plan view of FIG. 2. Inlet block 36 has fluid inlet hose connection 40 and provides a mounting slot 39A for torsion wire spring 34 and also provides a sealed mounting for one end of rubber tube 52. Outlet block 38 contains a fluid exit port 62 and provides a mounting slot 39B for torsion wire spring 34 and also provides a sealed mounting for the other end of rubber tube 52. In addition, inlet block 36 has an attachment face 64A and outlet block 38 has an attachment face 64B, these two faces being covered with a suitable adhesive material as a means of permanent attachment to the bottom face 32 of toilet seat 30.

Figure 6:
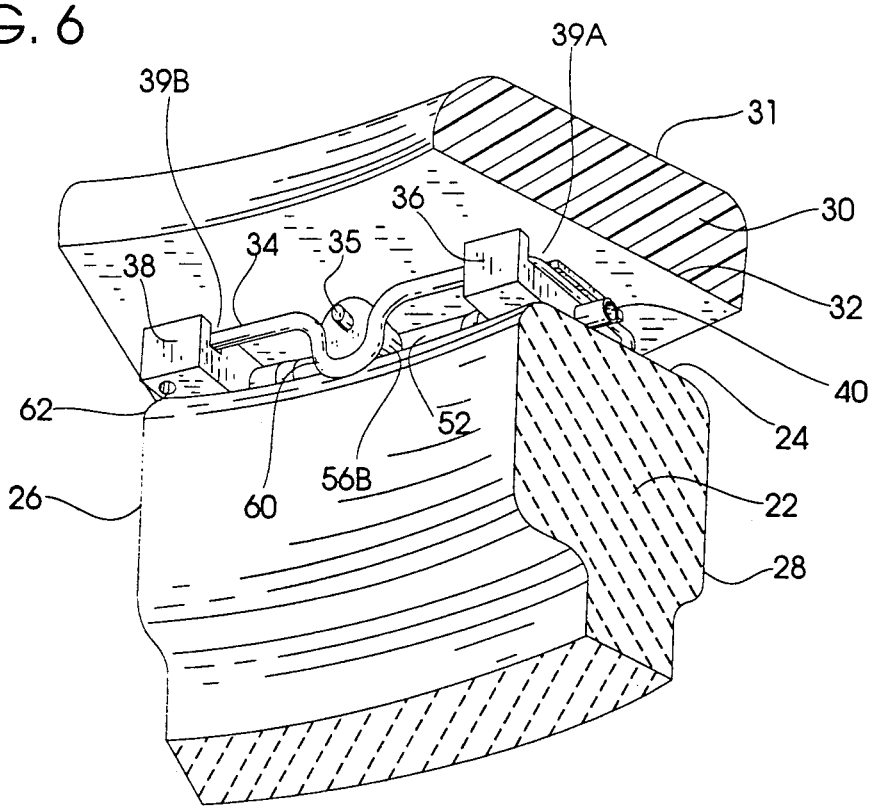
FIG. 6 shows a lower perspective view of the mounted semiautomatic fluid dispenser with the toilet seat fully lowered.

Torsion wire spring 34 has a figure 6 shape, and clearance is provided in mounting slots 39A and 39B to accommodate a change in effective length of this spring as it flexes during the pumping and refilling cycle. Pump actuating section 35 of spring 34 is biased toward spring travel stop loop 60, causing the end of pump actuating section 35 to move against spring travel stop loop 60 when pump actuating section 35 is not otherwise restrained. Long actuating roller 56A, tube flattening sleeve 58 and short actuating roller 56B are all mounted on pump actuating section 35 of torsion wire spring 34, allowing these four components to move in unison in relation to the remainder of the fluid dispenser.

Figure 3:
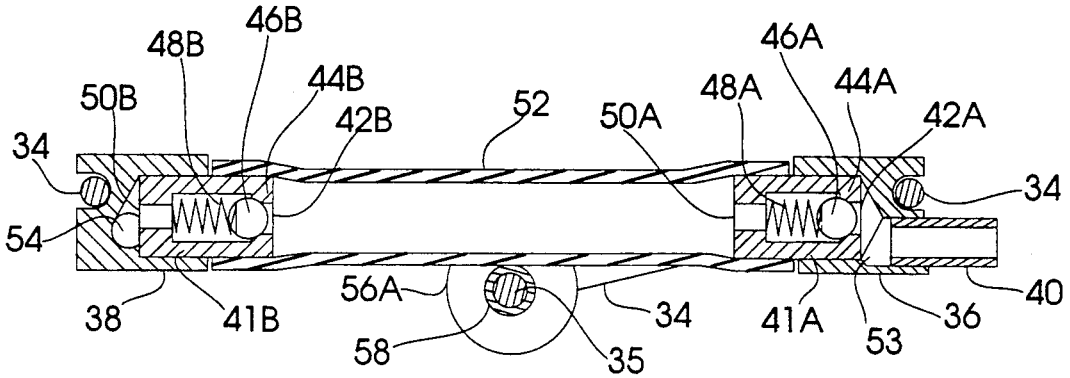
FIG. 3 shows a view in detail indicated by the section lines 1—1 in FIG. 2 of the semiautomatic fluid dispenser pump with rubber tube 52 undistorted.
Figure 4:
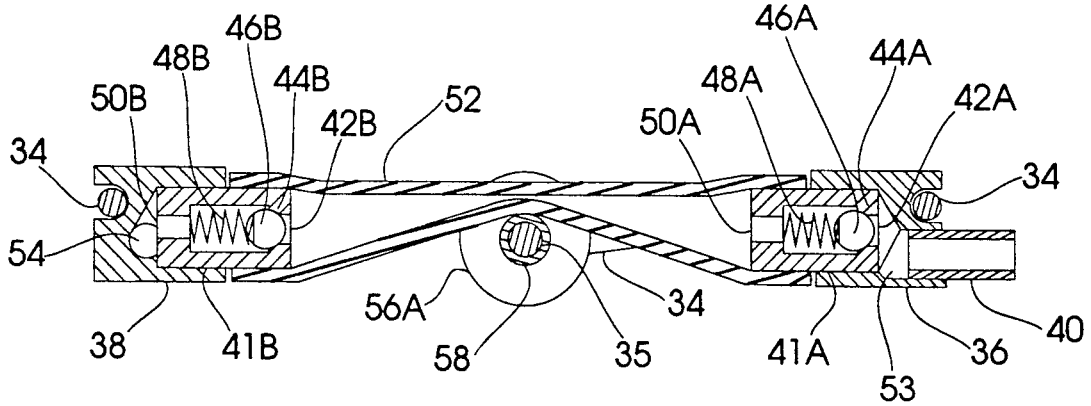
FIG. 4 shows a view in detail indicated by the section lines 1—1 in FIG. 2 of the semiautomatic fluid dispenser pump with rubber tube 52 distorted.

The operating details of the fluid pump can best be seen in FIG. 3 and FIG. 4 which are views in detail indicated by section lines 1—1 in FIG. 2. Check housing 41A contains check inlet port 42A, check outlet port 50A, and check ball 46A which is forced against check seat 44A by check spring 48A. In like manner, check housing 41B contains check inlet port 42B, check outlet port 50B, and check ball 46B which is forced against check seat 44B by check spring 48B.

The dispensing cycle is initiated by long actuating roller 56A, tube flattening sleeve 58, and short actuating roller 56B moving in unison toward rubber tube 52, which forces tube flattening sleeve 58 against rubber tube 52, thereby distorting the center of this tube from a circular shape into a flat oval shape. This distortion reduces the inside volume of rubber tube 52, causing a pressure buildup inside this tube. Assuming rubber tube 52 is full of fluid, this increased pressure is exerted on the surface of check ball 46A except for a small area facing check inlet port 42A and isolated by check seat 44A, thereby allowing this small area to remain at atmospheric pressure. This pressure differential across check ball 46A adds to the biasing force of spring 48A holding check ball 46A against check seat 42A, thereby preventing the escape of fluid from rubber tube 52 through check outlet port 50A.

During this pressure build up in rubber tube 52, the surface of check ball 46B remains at atmospheric pressure except for a small area exposed to this pressure buildup through check inlet port 42B and isolated by check seat 44B. The resulting pressure differential causes check ball 46B to move off check seat 44B when the biasing force of spring 48B is exceeded. The fluid displaced by the distortion of rubber tube 52 is thus forced out of this tube, through open check seat 44B, and enters fluid outlet channel 54 through check outlet port 50B, and subsequently exits outlet block 38 through fluid exit port 62.

The refill cycle is initiated by long actuating roller 56A, tube flattening sleeve 58, and short actuating roller 56B moving in unison away from rubber pump tube 52, thereby allowing this distorted tube to resume its normal circular shape. This increases the internal volume of this tube, thereby reducing the pressure inside the tube. This reduced pressure is exerted on the small surface area of check ball 46B facing check inlet port 42B and isolated by check seat 44B. Since the remaining surface of check ball 46B is at atmospheric pressure, the resulting pressure differential across check ball 46B adds to the biasing force of check spring 48B holding this ball against check seat 44B, thereby preventing fluid from entering rubber tube 52 through exit port 42B.

This reduced pressure is also exerted on the surface of check ball 46A except for the small area facing inlet port 42A and isolated by check seat 44A, thereby allowing this small area to remain at atmospheric pressure. This pressure differential across check ball 46A causes check ball 46A to move away from check seat 44A when the pressure differential across check ball 46A exceeds the biasing force of check spring 48A, thus permitting fluid to flow into rubber tube 52, thereby allowing this tube to return to its normal round shape.

Figure 5:
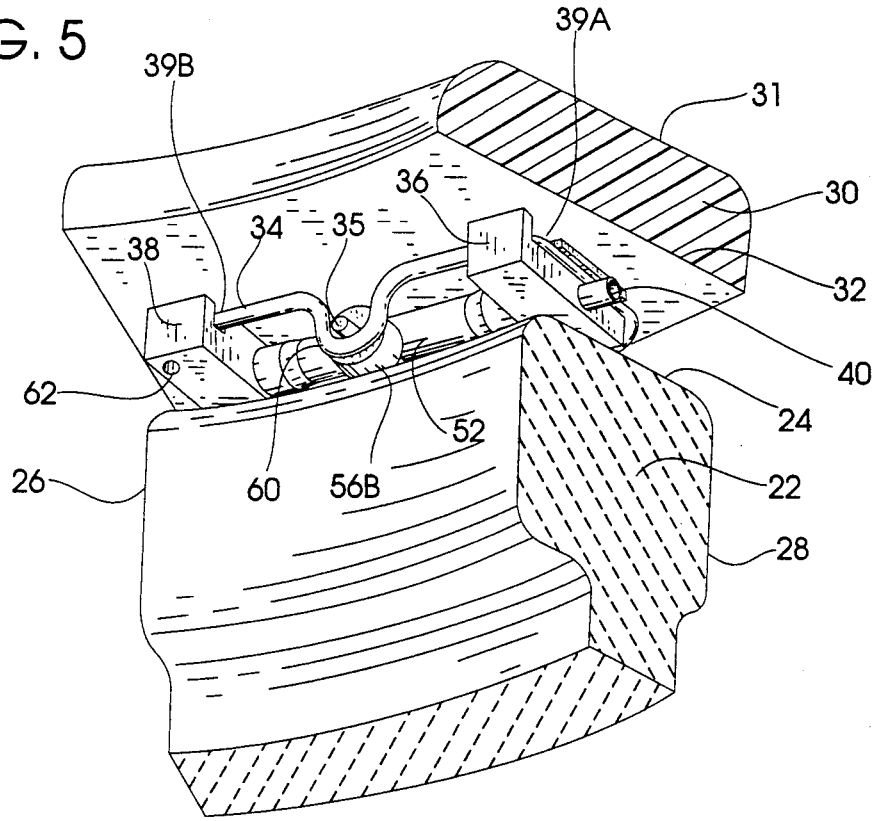
FIG. 5 shows a lower perspective view of the mounted semiautomatic fluid dispenser with the toilet seat slightly raised.

FIG. 5 shows the semiautomatic fluid dispenser mounted on the bottom face 32 of toilet seat 30 by means of a suitable adhesive applied to attachment faces 64A and 64B, with long actuating roller 56A and short actuating 56B resting against top face 24 of toilet bowl 22 and the end of pump actuating section 35 of spring 34 resting against spring travel stop loop 60. Attachment faces 64A and 64B can best be seen in FIG. 2, and actuating rollers 56A and 56B can best be seen in FIG. 1 and FIG. 2. In this configuration, the overall height of the semiautomatic fluid dispenser is greater than the vertical clearance between top face 24 of the toilet bowl 22 and bottom face 32 of toilet seat 30 when the toilet seat is fully lowered. There is sufficient biasing force in torsion wire spring 34 to force toilet seat 30 upward into a slightly raised position when only the downward force of the weight of toilet seat 30 is present. Rubber tube 52 is now in its normal round configuration as can be best seen in FIG. 3.

FIG. 6 shows toilet seat 30 in its fully lowered position, as caused by a person sitting on top 31 of toilet seat 30 and thus overcoming the biasing force in torsion wire spring 34 which has been holding toilet seat 30 in a slightly raised position, and also holding tube flattening sleeve 58 away from rubber tube 52. This downward movement of toilet seat 30 reduces the vertical clearance between bottom face 32 of toilet seat 30 and top face 24 of toilet bowl 22, thus forcing spring travel stop 60 to move downward away from the end of operating section 35 of torsion wire spring 34, and moving rubber tube 52 downward against tube flattening sleeve 58, thereby initiating the fluid dispensing cycle described above. At the end of the downward movement of toilet seat 30, rubber tube 52 is in its fully distorted shape, as can best be seen in FIG. 4.

When the person using the toilet stands up, toilet seat 30 raises due to the biasing force of torsion wire spring 34. When spring travel stop 60 moves upward in unison with the upward movement of toilet seat 30 and contacts the end of pump actuating section 35 of spring 34, the raising motion of toilet seat 30 ceases. This raising motion moves rubber tube 32 away from tube flattening sleeve 58, thereby initiating the dispenser refill cycle as described above. Toilet seat 30 remains in this slightly raised position until it is once again sat upon, thereby initiating another fluid dispensing cycle.

As shown in FIG. 6, the semiautomatic fluid dispenser is positioned on the bottom face 32 of toilet seat 30 to so as to permit spring travel stop loop 60 to overhang the inside face of toilet bowl 26 sufficiently to prevent contact with this face. In addition, fluid exit port 62 is positioned so as to permit fluid exiting from this port to fall onto the sloping inside face 26 of toilet bowl 22 allowing the force of gravity to cause the fluid to run down this sloping face and contact the surface of the water in the toilet bowl where the fluid forms the desired odor blocking and odor neutralizing film.

Accordingly, the reader will see that the odor control method of this invention is effective in eliminating lingering bathroom odor. Furthermore, this odor control method has the additional advantages in that:

it suppresses and neutralizes bathroom odor within the confines of the toilet bowl, thereby maintaining air freshness in the bathroom;

only a few drops of inexpensive fluid mixture are required to create and maintain the odor blocking film formed on water in a toilet bowl, thereby making this a low cost method of odor control in comparison to other methods presently used;

the use of this fluid eliminates the need for using an exhaust fan in the bathroom to remove odors, thereby saving energy;

the long lasting nature of the odor suppressing and neutralizing film formed on the surface of water in a toilet bowl permits the toilet to be used several times and an elapsed time of several hours and even days between toilet flushings without the release into the air of bathroom odor, thereby conserving water;

The use of biodegradable fluids creates a minimum impact on the environment.

Although the description above contains many specificities, these should not be construed as limiting the scope of the invention but as merely providing illustrations of some of the presently preferred embodiments of this invention. For example a solenoid operated fluid dispenser could be controlled by a proximity switch activated by a person being seated on the toilet. This embodiment would require only a small fluid dispensing tube overhanging the top of the toilet bowl with the remaining components located nearby, making it more suitable for use in public rest rooms.

A manual dispenser could be used in home toilets, as well as in commode type toilets commonly found in rest homes.

Thus the scope of the invention should be determined by the appended claims and their legal equivalents, rather than by the examples given.

I claim:

1. A dispenser for injecting film forming hydrocarbon fluid into a toilet bowl to trap obnoxious gasses, said dispenser comprising:

an inlet block for receiving said fluid from an external source;

an outlet block spaced apart from said inlet block for outputting fluid into said bowl;

a deformable tube extending between said inlet and outlet blocks, said tube establishing a fluid flow pathway between said blocks;

spring biased activation means for compressing said tube when downward force is placed on a seat of said toilet and for uncompressing said tube when said force is removed;

whereby tube compression forces fluid into said toilet bowl and the subsequent release of said compression suctions fluid into said tube from said source.

2. The dispenser as defined in claim 1 wherein an automatic hydrocarbon fluid is mixed with said film forming hydrocarbon fluid.

3. The dispenser as defined in claim 2 wherein said film forming fluid is biodegradable.

4. The dispenser as defined in claim 2 wherein said film forming hydrocarbon is a chlorinated hydrocarbon.

5. The dispenser as defined in claim 2 wherein said aromatic hydrocarbon is methyl salicylate.

6. The dispenser as defined in claim 1 wherein said inlet and outlet blocks are adapted to be secured to an underside of said toilet seat in a spaced apart relationship.

7. The dispenser as defined in claim 1 wherein said activation means comprises a torsion spring extending between said blocks, said spring comprising a tube contacting cross bar member normally biased out of contact with said tube, said tube contacting member adapted to rest on a rim of said toilet bowl.

8. The dispenser as defined in claim 7 further comprising rollers disposed on said cross bar for contacting said toilet seat and a rim of said toilet.

9. The dispenser as defined in claim 8 further comprising a tube flattening sleeve disposed on the cross bar member between said rollers for contacting said tube.

10. A dispenser for eliminating bathroom odor, said dispenser adapted to output a predetermined amount of a film forming hydrocarbon fluid into the water in a toilet bowl to trap gases in said water, said dispenser comprising:

an inlet block for communicating with a source of said fluid secured to an underside of a toilet seat, and further comprising an output;

a first check valve connected to said output to control the direction of flow of fluid through said inlet block;

an outlet block adapted to be secured to the underside said toilet seat and spaced apart from said inlet block, said outlet block comprising a fluid input and an output disposed adjacent said toilet bowl;

a second check valve connected to said outlet block input to control the direction of flow of fluid through said outlet block;

a deformable rubber tube extending between said first and second check valves to establish fluid flow communication between said inlet block and said outlet block;

a tube contacting spring normally biased out of contact with said tube for compressing said tube when downward force is applied to said toilet seat;

whereby downward force on said seat compresses said tube to forcibly dispense said fluid into said toilet bowl and subsequent release of said force enables said tube to draw fluid into said tube, through said inlet block and associated check valve, from said source, 11. The dispenser as defined in claim 10 wherein an aromatic hydrocarbon fluid is mixed with said film forming hydrocarbon fluid.

12. The dispenser as defined in claim 11 wherein said aromatic hydrocarbon is methyl salicylate.

13. The dispenser as defined in claim 11 wherein said film forming hydrocarbon is a chlorinated hydrocarbon.

14. The dispenser as defined in claim 10 wherein said tube contacting spring comprises a center cross bar and rollers disposed on said center cross bar for contacting said toilet seat and a rim of said toilet.

15. The dispenser as defined in claim 14 further comprising a tube flattening sleeve disposed on said cross bar between said rollers for contacting said tube.

16. The dispenser as defined in claim 10 wherein said fluids are biodegradable.

* * * * *